US008123473B2

(12) United States Patent
Shapiro

(10) Patent No.: US 8,123,473 B2
(45) Date of Patent: Feb. 28, 2012

(54) SHROUD HANGER WITH DIFFUSED COOLING PASSAGE

(75) Inventor: Jason David Shapiro, Methuen, MA (US)

(73) Assignee: General Electric Company, Schenectady, NY (US)

( * ) Notice: Subject to any disclaimer, the term of this patent is extended or adjusted under 35 U.S.C. 154(b) by 713 days.

(21) Appl. No.: 12/262,606

(22) Filed: Oct. 31, 2008

(65) Prior Publication Data

US 2010/0111670 A1 May 6, 2010

(51) Int. Cl.
*F01D 25/12* (2006.01)
*F01D 11/08* (2006.01)

(52) U.S. Cl. ..... 415/173.1; 415/116

(58) Field of Classification Search ..... 415/173.1
See application file for complete search history.

(56) References Cited

U.S. PATENT DOCUMENTS 5,165,847 A 11/1992 Proctor et al.
5,169,287 A 12/1992 Proctor et al.
5,273,396 A * 12/1993 Albrecht et al. ..... 415/173.1
5,553,999 A * 9/1996 Proctor et al. ..... 415/173.1
5,593,276 A * 1/1997 Proctor et al. ..... 415/173.1
6,139,257 A 10/2000 Proctor et al.
6,666,645 B1 12/2003 Arilla et al.
6,679,680 B2 * 1/2004 Um et al. ..... 415/173.1
7,048,496 B2 * 5/2006 Proctor et al. ..... 415/115
7,607,885 B2 10/2009 Bosley et al.
2004/0086377 A1 * 5/2004 Proctor et al. ..... 415/116
2008/0131264 A1 6/2008 Lee et al.
2008/0206042 A1 8/2008 Lee et al.
2009/0202337 A1 8/2009 Bosley et al.

FOREIGN PATENT DOCUMENTS

EP 0515130 11/1992
EP 515130 A1 * 11/1992
FR 2216444 8/1974

* cited by examiner

*Primary Examiner* — Benjamin Sandvik
*Assistant Examiner* — Joseph Schoenholtz
(74) *Attorney, Agent, or Firm* — David J. Clement; Trego, Hines & Ladenheim, PLLC

(57) ABSTRACT

A shroud hanger for a gas turbine engine has an arcuate body with opposed inner and outer faces and opposed forward and aft ends, the channel having at least one cooling passage therein which includes: (a) a generally axially-aligned channel extending through the body, the channel having one end open to an exterior of the body; and (b) a generally radially-aligned diffuser extending through the inner face and intersecting the channel.

16 Claims, 7 Drawing Sheets

SHROUD HANGER WITH DIFFUSED COOLING PASSAGE

BACKGROUND OF THE INVENTION

This invention relates generally to gas turbine engine turbines and more particularly to methods for cooling turbine sections of such engines.

A gas turbine engine includes a turbomachinery core having a high pressure compressor, combustor, and high pressure or gas generator turbine in serial flow relationship. The core is operable in a known manner to generate a primary gas flow.

The gas generator turbine includes one or more rotors which extract energy from the primary gas flow. Each rotor comprises an annular array of blades or buckets carried by a rotating disk. The flowpath through the rotor is defined in part Typically two or more stages are used in serial flow relationship. These components operate in an extremely high temperature environment, and must be cooled by air flow to ensure adequate service life. Typically, the air used for cooling is extracted from one or more points in the compressor.

Conventional cooled turbine shrouds are supported by segmented hangers through which the shroud cooling air is supplied. This air is typically supplied through holes in the main body of the hanger. Once through the hanger, the air enters a plenum formed by the hanger and a sheet metal impingement baffle. The air then passed through the baffle and impinges on the shroud. In order to not damage the sheet metal baffle, it is preferable that the hanger holes be angled such that the air does not directly impinge on the baffle, or that the air is diffused before entering the plenum.

Current turbine shroud hangers either use straight holes which impinge directly on the baffle, or holes with partially cast diffusers. Turbine shroud hangers utilizing the direct impingement have experienced sheet metal baffle cracking due to excitation from the high velocity air coming from the hanger holes. Conventional cast diffusers require substantial space to be incorporated in and may require the use of quartz rods in the casting process.

BRIEF SUMMARY OF THE INVENTION

These and other shortcomings of the prior art are addressed by the present invention, which provides a turbine shroud hanger which incorporates a simple, compact impingement air diffuser.

According to one aspect of the invention, shroud hanger for a gas turbine engine has an arcuate body with opposed inner and outer faces and opposed forward and aft ends, the channel having at least one cooling passage therein which includes: (a) a generally axially-aligned channel extending through the body, the channel having one end open to an exterior of the body; and (b) a generally radially-aligned diffuser extending through the inner face and intersecting the channel.

According to another aspect of the invention a method of making a shroud hanger for a gas turbine engine includes: (a) casting an arcuate body with opposed inner and outer faces and opposed forward and aft ends; (b) forming a generally radially-aligned diffuser extending through the inner face; and (c) forming a generally axially-aligned channel extending through the body, the channel having one end open to an exterior of the body and intersecting the diffuser.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
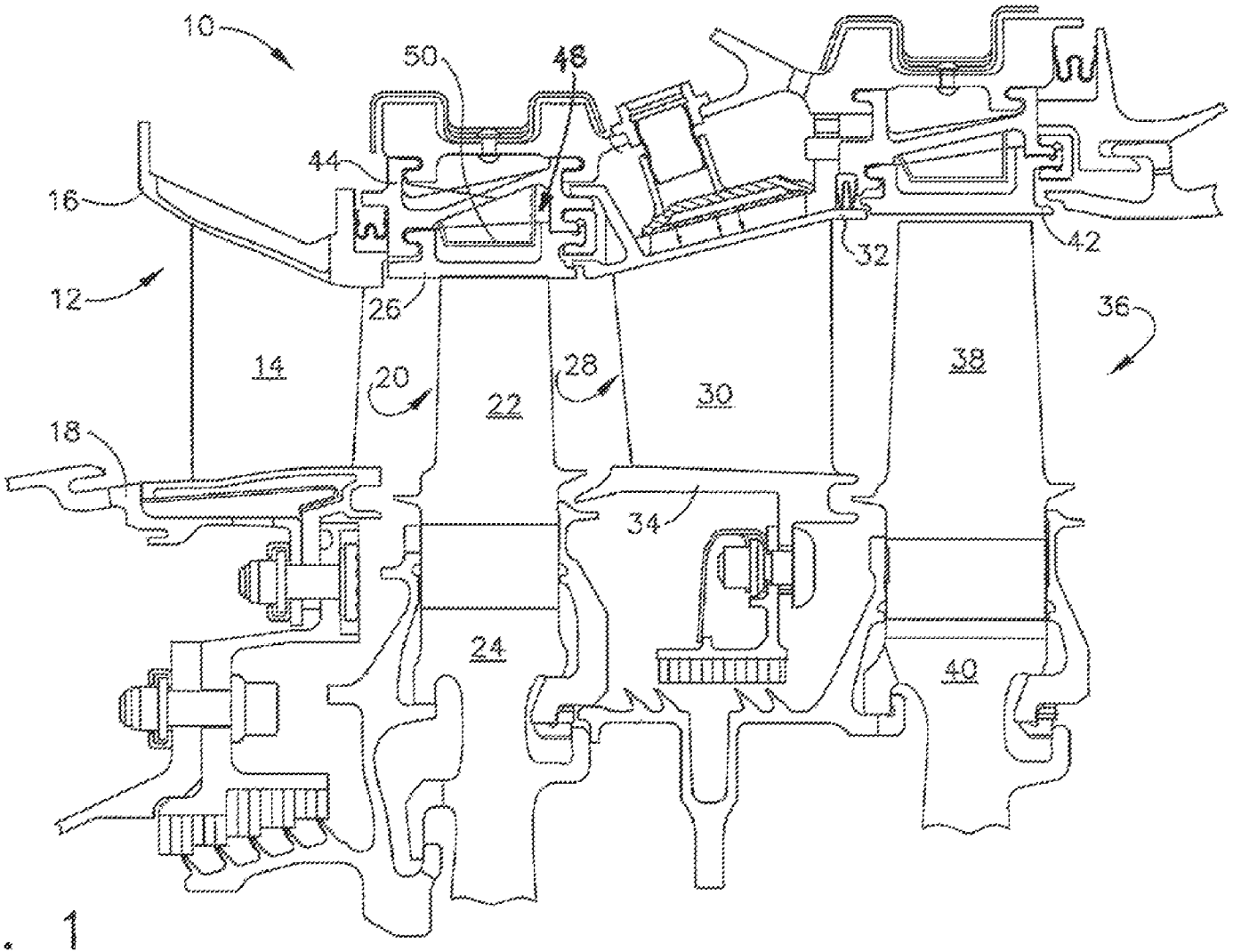
FIG. 1 a schematic cross-sectional view of a gas generator core of a turbine engine constructed in accordance with an aspect of the present invention.
Figure 2:
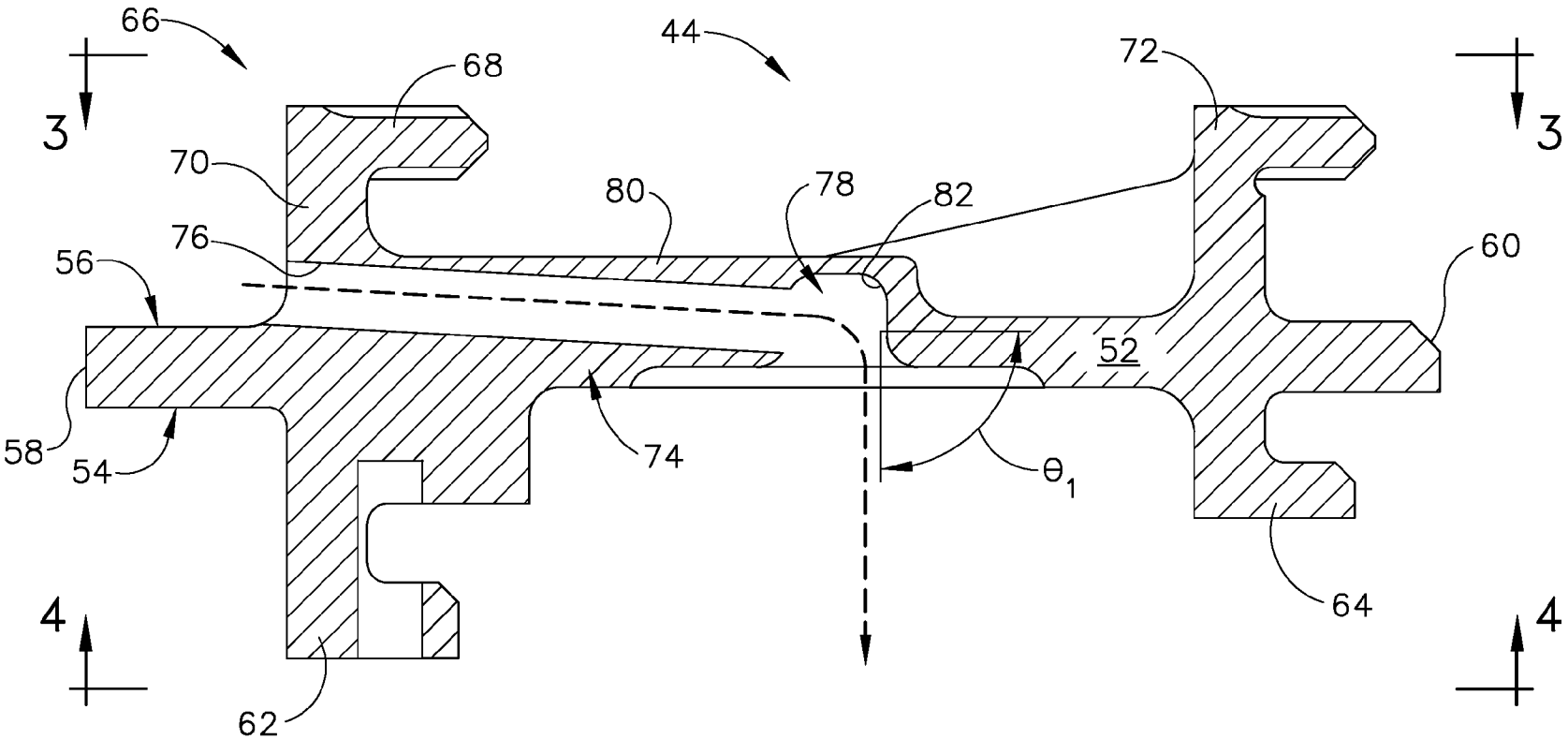
FIG. 2 is a cross-sectional view of a turbine shroud hanger shown in FIG. 1.

Referring to the drawings wherein identical reference numerals denote the same elements throughout the various views, FIGS. 1 and 2 depict a gas generator turbine 10 which forms a portion of a gas turbine. It includes a first stage nozzle 12 which comprises a plurality of circumferentially spaced airfoil-shaped hollow first stage vanes 14 that are supported between an arcuate, segmented first stage outer band 16 and an arcuate, segmented first stage inner band 18. The first stage vanes 14, first stage outer band 16 and first stage inner band 18 are arranged into a plurality of circumferentially adjoining nozzle segments that collectively form a complete 360° assembly. The first stage outer and inner bands 16 and 18 define the outer and inner radial flowpath boundaries, respectively, for the hot gas stream flowing through the first stage nozzle 12. The first stage vanes 14 are configured so as to optimally direct the combustion gases to a first stage rotor 20.

The first stage rotor 20 includes a array of airfoil-shaped first stage turbine blades 22 extending outwardly from a first stage disk 24 that rotates about the centerline axis of the engine. A segmented, arcuate first stage shroud 26 is arranged so as to closely surround the first stage turbine blades 22 and thereby define the outer radial flowpath boundary for the hot gas stream flowing through the first stage rotor 20.

A second stage nozzle 28 is positioned downstream of the first stage rotor 20, and comprises a plurality of circumferentially spaced airfoil-shaped hollow second stage vanes 30 that are supported between an arcuate, segmented second stage outer band 32 and an arcuate, segmented second stage inner band 34. The second stage vanes 30, second stage outer band 32 and second stage inner band 34 are arranged into a plurality of circumferentially adjoining nozzle segments that collectively form a complete 360° assembly. The second stage outer and inner bands 32 and 34 define the outer and inner radial flowpath boundaries, respectively, for the hot gas stream flowing through the second stage turbine nozzle 28. The second stage vanes 30 are configured so as to optimally direct the combustion gases to a second stage rotor 36.

The second stage rotor 36 includes a radially array of airfoil-shaped second stage turbine blades 38 extending radially outwardly from a second stage disk 40 that rotates about the centerline axis of the engine. A segmented arcuate second stage shroud 42 is arranged so as to closely surround the second stage turbine blades 38 and thereby define the outer radial flowpath boundary for the hot gas stream flowing through the second stage rotor 36.

The segments of the first stage shroud 26 are supported by an array of arcuate first stage shroud hangers 44 that are in turn carried by an arcuate shroud support 46, for example using the illustrated hooks, rails, and C-clips in a known manner. A shroud plenum 48 is defined between the first stage shroud hangers 44 and the first stage shroud 26. The shroud plenum 48 contains a baffle 50 that is pierced with impingement cooling holes in a known manner.

Figure 3:
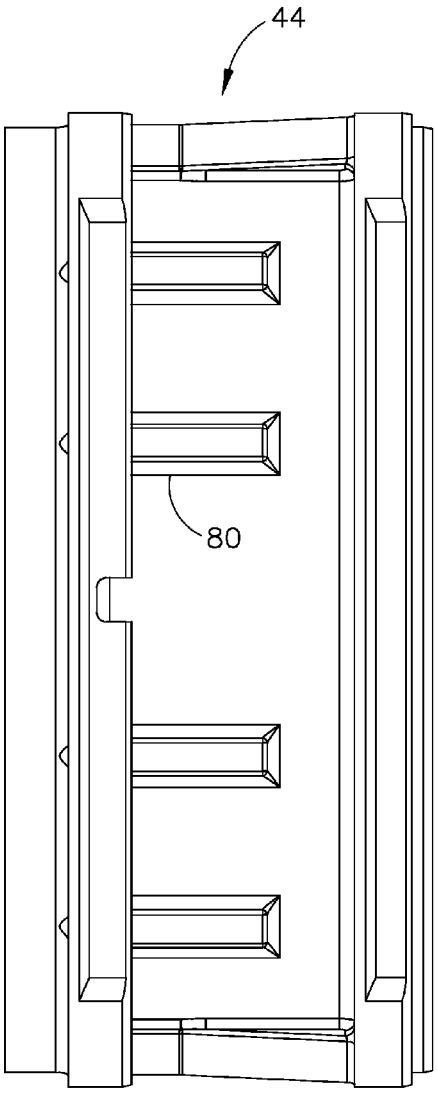
FIG. 3 is a view taken along lines 3-3 of FIG. 2.
Figure 4:
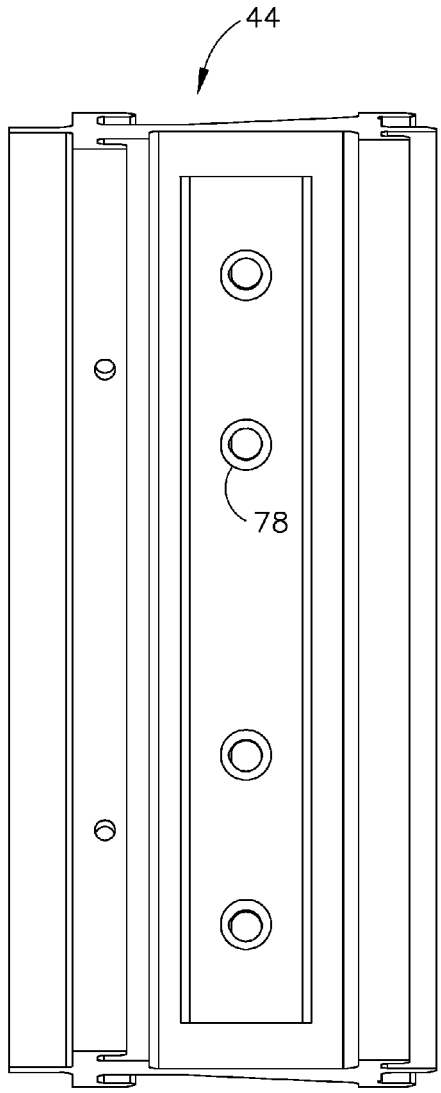
FIG. 4 is a view taken along lines 4-4 of FIG. 2.

FIGS. 2, 3, and 4 show one of the first stage shroud hangers 44 in more detail. It is noted that the first stage shroud hanger 44 is used merely as an example to illustrate the principles of the present invention, which are equally applicable to other similar components, for example the hangers supporting the second stage shrouds 42. The first stage shroud hanger 44 is a unitary casting and has an arcuate body 52 with opposed inner and outer faces 54 and 56, and opposed forward and aft ends 58 and 60. A forward hook 62 having a generally L-shaped cross-section extends radially inward from the inner face 54, at the forward end 58. An aft hook 64 having a generally L-shaped cross-section extends radially inward from the inner face 54, at the aft end 60.

A forward mounting rail 66 having a generally L-shaped cross-section with axial and radial legs 68 and 70 extends from the outer face 56, at the forward end 58. An aft mounting rail 72 having a generally L-shaped cross-section extends from the outer face 56, at the aft end 60.

An annular array of cooling passages 74 are formed in the body 52. Each cooling passage 74 has a generally axially-aligned channel 76 and a generally radially-aligned diffuser 78. The channel 76 passes through the radial leg 70 of the forward mounting rail 66 and extends through the body 52. In the illustrated example each of the channels 76 passes through an optional boss 80 which protrudes radially outward from the outer face 56 of the body 52. The aft end of the channel 76 joins the diffuser 78. The diffuser 78 passes through the inner face 54 and extends through the body 52 into the boss 80. The cross-sectional flow area of the diffuser 78 is significantly greater than that of the channel 76. In this example the angle $\theta_1$ between a back wall 82 of the diffuser 78 and the centerline of the channel 76 is about 90 degrees.

In operation, cooling air from a source within the engine, for example compressor bleed air, is supplied to the channel 76. The high velocity air coming through the channel 76 will lose some of its velocity head when it impinges on the back wall 82 of the diffuser 78. As this is a part of a relatively thick casting, it can be made to have sufficient thickness such that there is no risk of damage due to excitation from the cooling air. The air, with lower velocity, then turns radially inward as shown by the arrow in FIG. 2, and diffuses. It subsequently flows into the shroud plenum 48 (see FIG. 1) where is it used for impingement cooling in a known manner. Based on analysis, the axial position of the diffuser 78 can be preferentially located for each specific application, to ensure a uniform distribution of air in the shroud plenum 48, which results in uniform impingement cooling for the first stage shroud 26.

Figure 5:
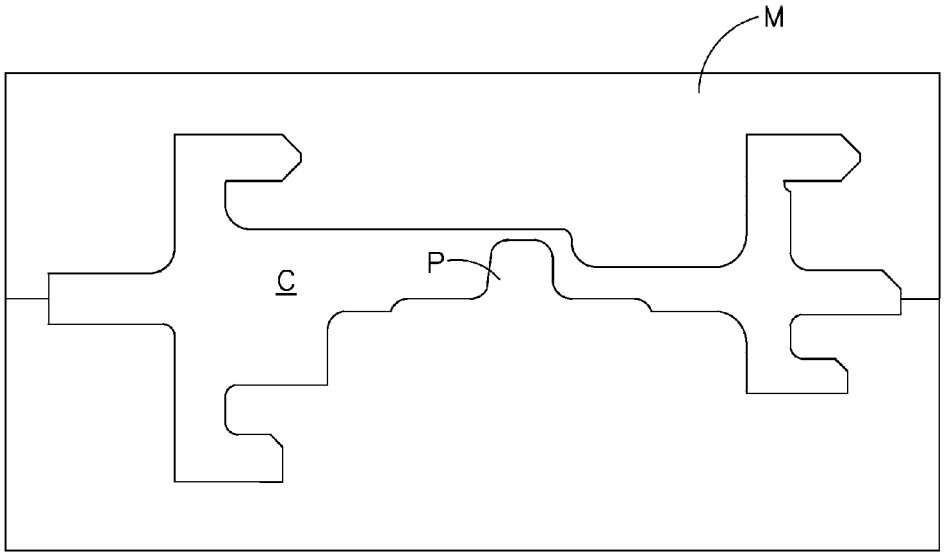
FIG. 5 is a schematic cross-sectional view of a mold for casting a turbine shroud hanger.
Figure 6:
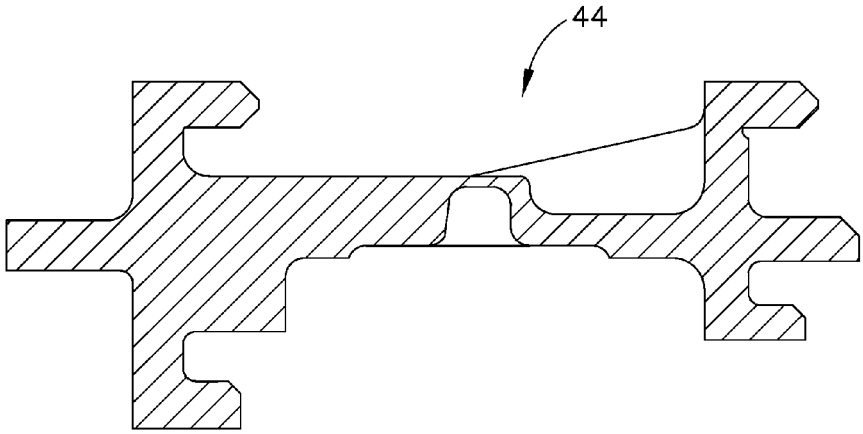
FIG. 6 is a schematic cross-sectional view of a shroud hanger cast using the mold of FIG. 5.

The shroud hanger 44 may be manufactured using a known investment casting process, in which a ceramic mold is created (shown schematically at "M" in FIG. 5) which has a cavity "C" that defines the form of the shroud hanger 44 and its interior features. The mold cavity C includes an integral positive feature or plug "P" in the shape of the diffuser 78. The mold M is placed in a furnace, and liquid metal, for example a known cobalt- or nickel-based "superalloy", is poured into an opening therein (not shown). After the metal is allowed to cool and solidify, the external shell is broken and removed, exposing the casting which has taken the shape of the shroud hanger 44 including the diffuser 78, as shown in FIG. 6. Optionally, the diffuser 78 could be formed by machining after casting.

Figure 7:
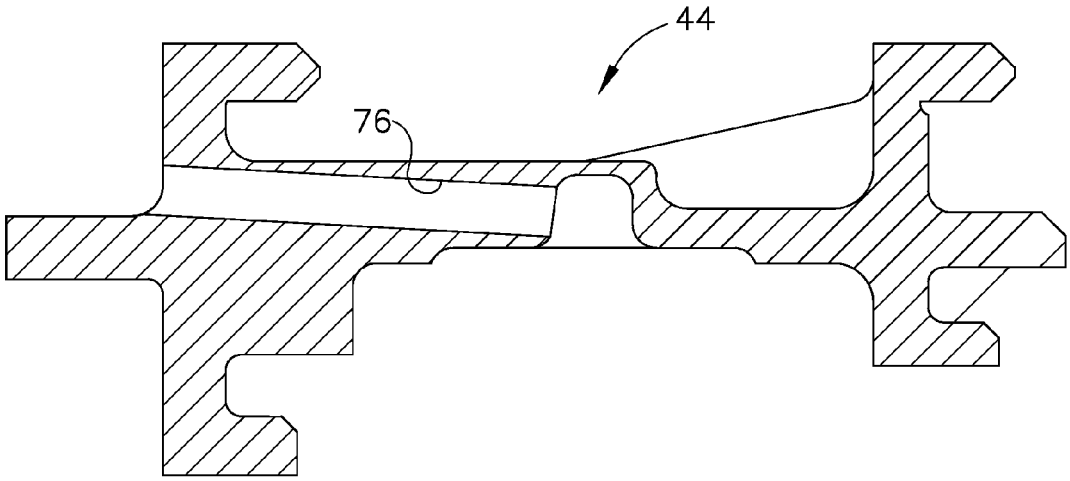
FIG. 7 is a view of the shroud hanger of FIG. 9 after a cooling passage has been machined therein.

After the casting process is complete, the channel 76 is formed by machining (e.g. by drilling, ECM, EDM, or a similar process) through the radial leg 70 and the boss 80 to intersect the diffuser 78, as shown in FIG. 7. Optionally, the channel 76 could be formed during casting by incorporating a quartz rod or other refractory core element into the mold M in a known manner.

Figure 8:
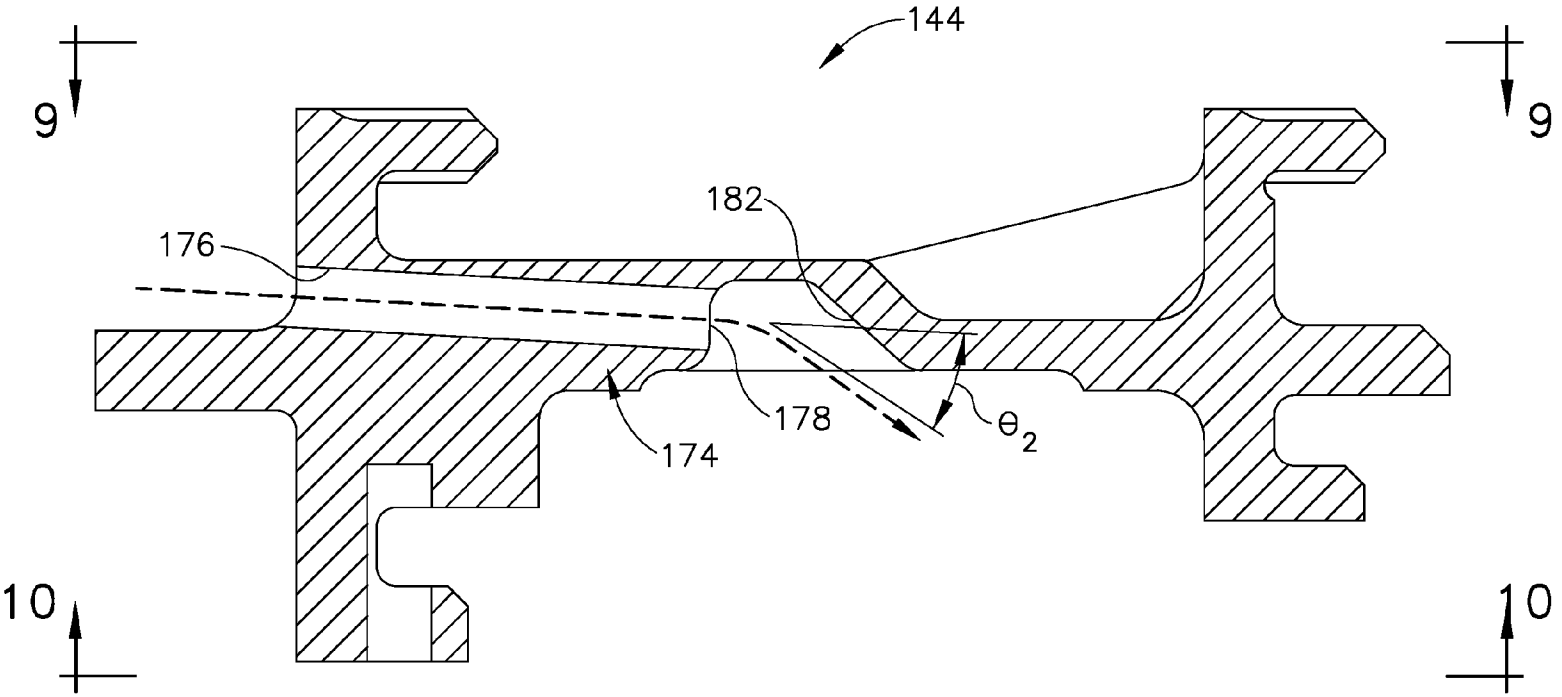
FIG. 8 is a cross-sectional view of an alternative turbine shroud hanger constructed in accordance with an aspect of the present invention.
Figure 9:
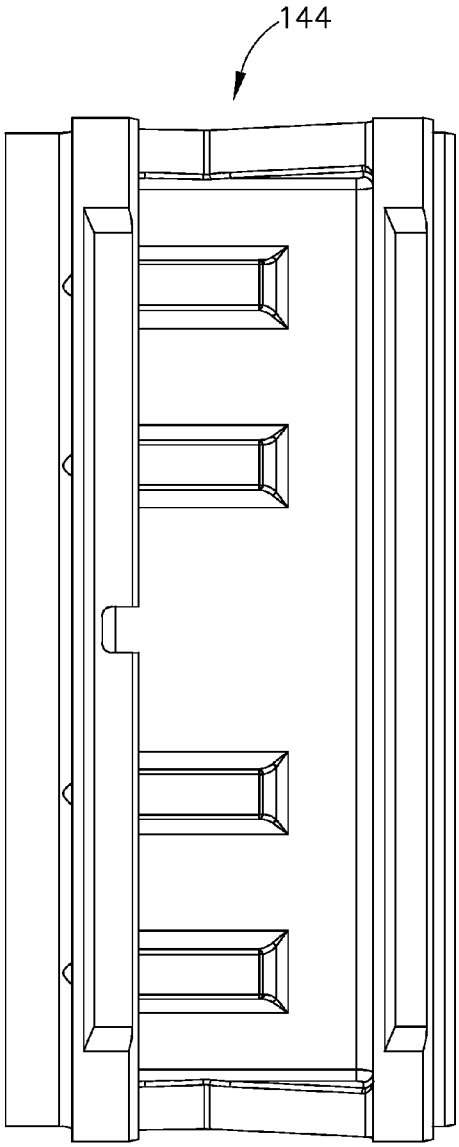
FIG. 9 is a view taken along lines 9-9 of FIG. 8.
Figure 10:
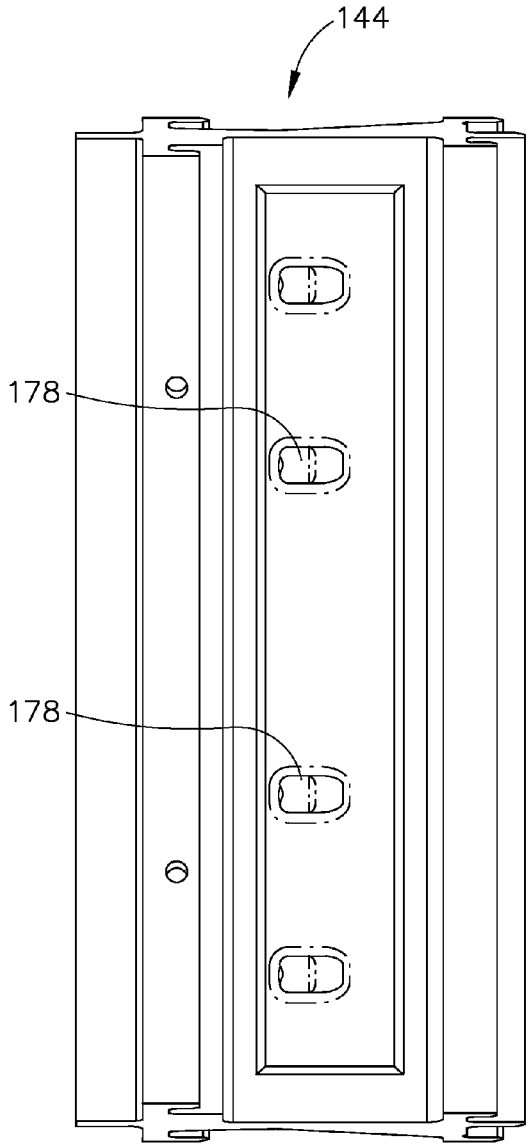
FIG. 10 is a view taken along lines 10-10 of FIG. 8.

The dimensions and shapes of the cooling passages 74 may be varied to suit a particular application. For example, FIGS. 8-10 illustrate an alternative shroud hanger 144 similar in construction to the shroud hanger 44 described above. It includes a cooling passage 174 comprising a channel 176 and a diffuser 178. In this example the angle $\theta_2$ between a back wall 182 of the diffuser 178 and the centerline of the channel 176 is about 45 degrees. This design produces a lower pressure drop in the flow exiting the cooling passage 174 than the design shown in FIGS. 2-4, which may be desirable in some applications.

The shroud hanger described herein has several advantages over a conventional design. By targeting the channel 74 at a cast surface, baffle distress caused by high velocity impingement air is avoided. This configuration is also optimized to work in areas of limited space where there is not enough room for a typical in-line diffuser configuration. Finally, the cast features are relatively simple to create, reducing the cost and complexity of the manufacturing process.

The foregoing has described a shroud hanger for a gas turbine engine. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. A shroud hanger for a gas turbine engine comprising:

(a) an arcuate body with opposed inner and outer faces and opposed forward and aft ends, the body having at least one cooling passage therein which includes:

(i) a generally axially-aligned channel extending through the body, the channel having one end open to an exterior of the body; and (ii) a generally radially-aligned diffuser extending through the inner face and intersecting the channel, the diffuser including a back wall that is axially spaced away from the channel and that is disposed in a position traversing a centerline of the channel; and (b) at least one hook extending radially inward from the inner face.

2. The shroud hanger of claim 1 further including axially spaced-apart forward and aft mounting rails extending radially outward from the outer face of the body.

3. The shroud hanger of claim 2 wherein the channel passes through one of the mounting rails.

4. The shroud hanger of claim 1 further including at least one boss extending radially outward from the outer face of the body, wherein the at least one cooling passage is located at least partially within the at least one boss.

5. The shroud hanger of claim 1 wherein the at least one hook has a generally L-shaped cross-section.

6. The shroud hanger of claim 1 wherein a back wall is disposed at an non-parallel angle of about 90 degrees or less from a centerline of the channel.

7. The shroud hanger of claim 1 wherein a back wall is disposed at an angle of about 45 degrees to a centerline of the channel.

8. A method of making a shroud hanger for a gas turbine engine comprising:

(a) casting an arcuate body with opposed inner and outer faces and opposed forward and aft ends, and at least one hook extending radially inward from the inner face;

(b) forming a generally radially-aligned diffuser extending through the inner face; and (c) forming a generally axially-aligned channel extending through the body, the channel having one end open to an exterior of the body and intersecting the diffuser, wherein the diffuser includes a back wall that is axially spaced away from the channel and that is disposed in a position traversing a centerline of the channel.

9. The method of claim 8 wherein step (b) is carried out by casting the body using a mold which includes a positive feature that defines the shape of the diffuser.

10. The method of claim 8 wherein step (c) is carried out by machining the channel into the as-cast body.

11. The method of claim 8 wherein the shroud hanger further includes axially spaced-apart forward and aft mounting rails extending radially outward from the outer face of the body.

12. The method of claim 11 wherein the channel is formed so as to pass through one of the mounting rails.

13. The method of claim 8 further including at least one boss extending radially outward from the outer face of the body, wherein the at least one cooling passage is located at least partially within the at least one boss.

14. The method of claim 8 wherein the at least one hook has a generally L-shaped cross-section.

15. The method of claim 8 wherein a back wall is disposed at an non-parallel angle of about 90 degrees or less from a centerline of the channel.

16. The method of claim 8 wherein a back wall is disposed at an angle of about 45 degrees to a centerline of the channel.

* * * * *